United States Patent [19]

Durí

[11] Patent Number: 4,641,512

[45] Date of Patent: Feb. 10, 1987

[54] PLANT TO FORM AND COOL COILS

[75] Inventor: Antonino Durí, Pradamano, Italy

[73] Assignee: Danieli & C. Officine Meccaniche SpA, Italy

[21] Appl. No.: 771,041

[22] Filed: Aug. 30, 1985

[30] Foreign Application Priority Data

Sep. 19, 1984 [IT] Italy ..... 60460/84[U]

[51] Int. Cl.[4] ..... B21B 43/04; B21F 21/00; C21D 8/06

[52] U.S. Cl. ..... 72/201; 266/106

[58] Field of Search ..... 72/128, 201; 140/1, 140/2; 148/12 B; 266/106

[56] References Cited

U.S. PATENT DOCUMENTS 3,930,900 1/1976 Wilson ..... 148/12 B
4,056,186 11/1977 Hill ..... 266/106 UX
4,320,646 3/1982 Bindernagel ..... 148/12 B X
4,362,040 12/1982 Yamaguchi et al. ..... 266/106 X

FOREIGN PATENT DOCUMENTS 1199750 7/1970 United Kingdom ..... 266/106

*Primary Examiner*—E. Michael Combs
*Attorney, Agent, or Firm*—Wegner & Bretschneider

[57] ABSTRACT

Plant (10) to form and cool coils, which comprises a conveyor (12) for horizontal coils (19), conveyor means (24) for vertical coils (27), movable (114–214) cooling hoods (14), at least one coil-forming head (11) able to form horizontal (19) and vertical (27) coils, and a station (15) to form wound bundles, in which plant (10) the conveyor means (24) for vertical coils can move between an inactive position (FIG. 2) and a working position (FIG. 3) and cooperate with movable side walls (23) that are able to form momentarily, in cooperation with such hoods (14), a closed cooling tunnel (50).

6 Claims, 9 Drawing Figures

PLANT TO FORM AND COOL COILS

This invention concerns a plant to form and cool coils. To be more exact, the invention concerns an improved plant to form and cool coils which is suitable to form and cool coils positioned horizontally or vertically along a cooling conveyor.

Cooling conveyors are known which transport coils arranged horizontally on the conveyor. Such coils are formed by means of a coil-forming head of a known type.

The coils thus formed and carried along the cooling conveyor are finally discharged at a station in which they are formed into wound bundles.

Patent FR-A-2.010.428 in the name of Schloemann AG is known and discloses a cooling conveyor provided with toothed lateral chains having a variable spacing and with a chain at its bottom. This conveyor enables coils arranged vertically or coils arranged horizontally to be conveyed. The patent provides for the use of a turbulence hood able to move above the conveyor line and capable of being employed to change the cooling conditions.

U.S. Pat. No. 3,930,900 in the name of Morgan is also known and discloses a cooling tunnel which can be dismantled. An upper portion or cover is comprised and can be overturned; it can cooperate with side walls, which too can be overturned, so as to form a closed tunnel or an open conveyor belt respectively. This invention is suitable only to convey coils arranged horizontally.

The present invention provides a cooling conveyor which can be converted by means of suitable conveyors that can be overturned into working and inactive positions.

By means of these latter conveyors the cooling conveyor can be adapted for the controlled cooling of coils positioned vertically.

Conveyor means are also provided at the end of the cooling conveyor so as to discharge such coils and are able to perform the overturning of such coils for the successive formation of wound bundles.

In a preferred embodiment a trolley able to move crosswise to the cooling conveyor is located at the end of such conveyor. This trolley bears two pits for the formation of wound bundles, one of these pits being able to receive coils arranged horizontally on the cooling conveyor, whereas the other pit is able to accept coils positioned vertically, means suitable for conveying and overturning the coils being provided.

This trolley can be installed, for instance, on rails or guides so as to bring one or the other of the pits into correspondence with the cooling conveyor, depending on the operating configuration involved.

The invention also provides for the conversion of controlled cooling hoods with which the cooling conveyor is equipped. The purpose of this is to be able to accommodate coils positioned horizontally or vertically. Such conversion is performed advantageously according to the invention by the provision of removable side panels.

In a preferred embodiment these side panels are solidly fixed to the conveyor means, whether chains or other like conveyor means, which serve to support and carry the vertical coils.

In their working position these side panels provide a vertical extension of the cooling hoods, which can be suitably raised.

In this way it is possible to obtain a tunnel in which the coils can slide and which has a height greater than that required for the horizontal coils, such height being able to accommodate the vertical coils.

Lastly, the invention provides for the possibility of having an automatic feed of reels onto which the bundles of coils are wound in the station where such bundles are formed. The reels are also discharged in the same way on conveyors from the bundle-formation station.

In the particular case of coils formed of wire rod of a great diameter (as an indication, up to 35–40 mm.) a special type of reel is provided which is equipped with means to hold the top of the wound bundle. The reason for this is that, as the coils are naturally resilient, the wound bundle would tend to unwind and to rise as soon as it is released after the known compacting operation. Provision is therefore made for the employment of reels having means, such as expanding fins or projections, able to hold the top of the wound bundle on the reel, thus preventing the bundle unwinding when it is discharged.

The invention provides for the employment of one or more lines to convey and cool the coils, the lines being parallel to each other.

Advantageously only one carriage to bear the various collection pits will be provided at the end of the conveyor lines; or else a plurality of carriages serving several lines independently can be provided.

This invention is therefore embodied with a plant to form and cool coils, which comprises a conveyor for horizontal coils, conveyor means for vertical coils, movable cooling hoods, at least one coil-forming head able to form horizontal and vertical coils, and a station to form wound bundles, the plant being characterized in that it comprises conveyor means for vertical coils which can move between an inactive position and a working position and which cooperate with movable side walls that are able to form momentarily, in cooperation with such hoods, a closed cooling tunnel.

We shall describe hereinafter a preferred embodiment of a plant according to the invention, as a non-restrictive example, with the help of the attached figures, in which:

FIG. 1 gives a diagrammatic plan view of a plant according to the invention;

Figure 9:
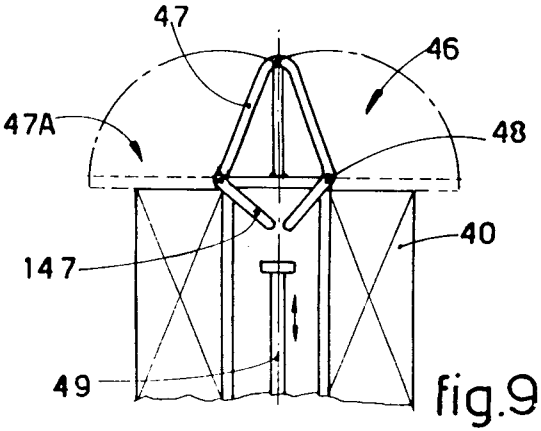

FIG. 9 lastly shows a possible embodiment of a reel with means to hold the wound bundle.

Figure 1:
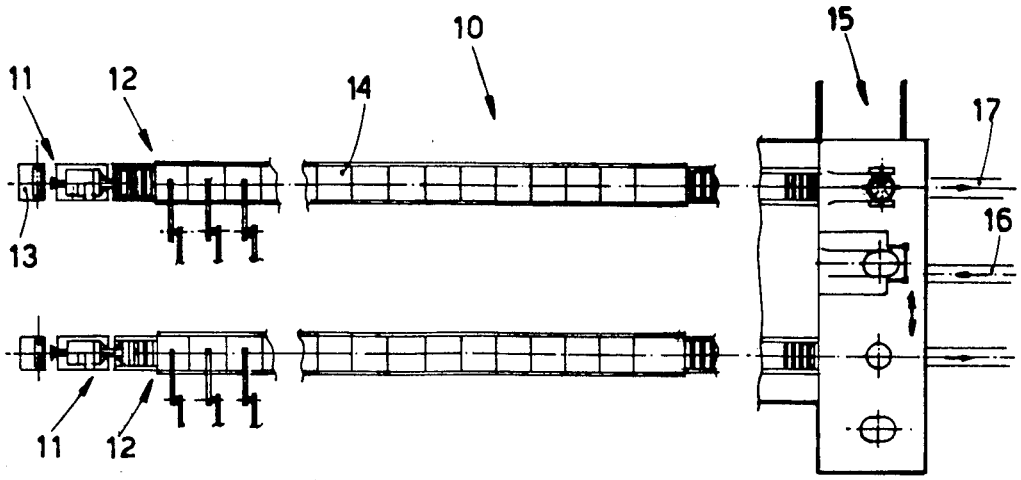

FIG. 1 gives a diagrammatic plan view of a plant 10 to form and cool coils according to the invention.

The figure shows two forming and cooling lines side by side according to the embodiment disclosed as an example.

However, it is possible to provide only one of such lines or else more than two, depending on the specific plant requirements.

The position of entry of rolled rods is on the left of the figure. The rod is fed by a drawing unit with rollers 13 cooperating with a coil-forming head 11 of a known type. Cooling conveyors 12 cooperate with the coil-forming heads 11 and in this case are roller conveyors and comprise hoods 14 to provide controlled cooling; these hoods will be described in greater detail in the following text.

A station 15 to form wound bundles will be disclosed in more detail hereinafter with specific reference to FIGS. 6, 7 and 8.

Conveyors 16–17 respectively deliver reels for winding the wound bundles and discharge the wound bundles.

Figure 2:
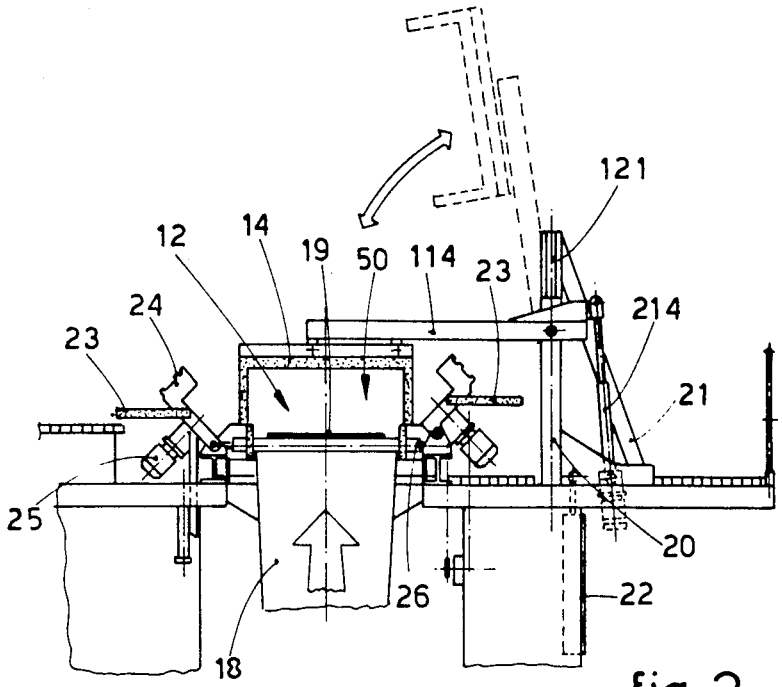
FIGS. 2 and 3 show two possible working conditions of the plant.
Figure 3:
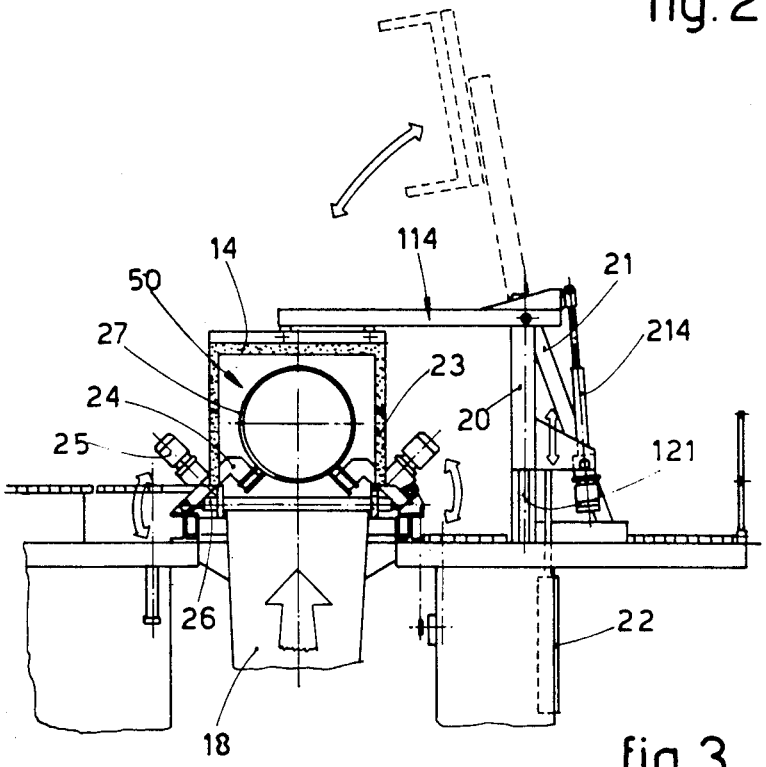

FIGS. 2 and 3 show two sections of the cooling line, including the roller conveyors 12 providing the cooling.

FIG. 2 shows a working condition corresponding to the conveying and controlled cooling of coils 19 formed horizontally by the forming head 11.

The coils 19 slide in a known manner on a cooling conveyor 12 consisting of powered rollers, air being blown at 18 from below upwards. As is well known, this blowing of air has the purpose of speeding up and controlling the cooling and is provided in ways known in the present state of the art.

FIG. 2 shows the hoods 14 upheld by arms 114, which can be overturned by an actuator 214, which in this example is a jack.

The whole assemblage of hood 14, arm 114 and jack 214 is sustained by an element 20, which can run on guides 121 machined in an upright 21.

When driven by an actuator 22, which in this case too is a jack, the whole element 20 can be lifted as shown in FIG. 3. This serves to change from the configuration of FIG. 2 to that of FIG. 3. In fact, it is possible to see auxiliary side panels 23, each of which is solidly fixed to a chain conveyor 24; motors 25 to drive each conveyor 24 can also be seen.

The side panels 23 are swung across by actuator means 26, which may consist, for instace, of jacks, or hydraulically operated screw-threaded shafts, or electromechanical means, or other equivalent means known in the present state of the art.

FIG. 3 shows a working configuration corresponding to employment with vertically positioned coils 27. In this case the conveyors 24 with the auxiliary side panels 23 are swung over inwards by the actuator 26 after the assemblage of the hood 14, arm 114 and movable support element 20 has been lifted.

In this way a cooling tunnel 50 is obtained which has an inside height equal to the sum of the height of the hood 14 and of the height of the auxiliary side panels 23. Thus the cooling tunnel 50 can accommodate the vertical coils 27, which run along the chain conveyors 24 driven by the motors 25.

The actuator 214 itself is supported by the element 20 and moves en bloc with the same. In the working configurations of both FIG. 2 and FIG. 3 respectively it is therefore possible to lift the upper hood 14 in identical manners (see the positions marked with lines of dashes in FIGS. 2 and 3).

Figure 4:
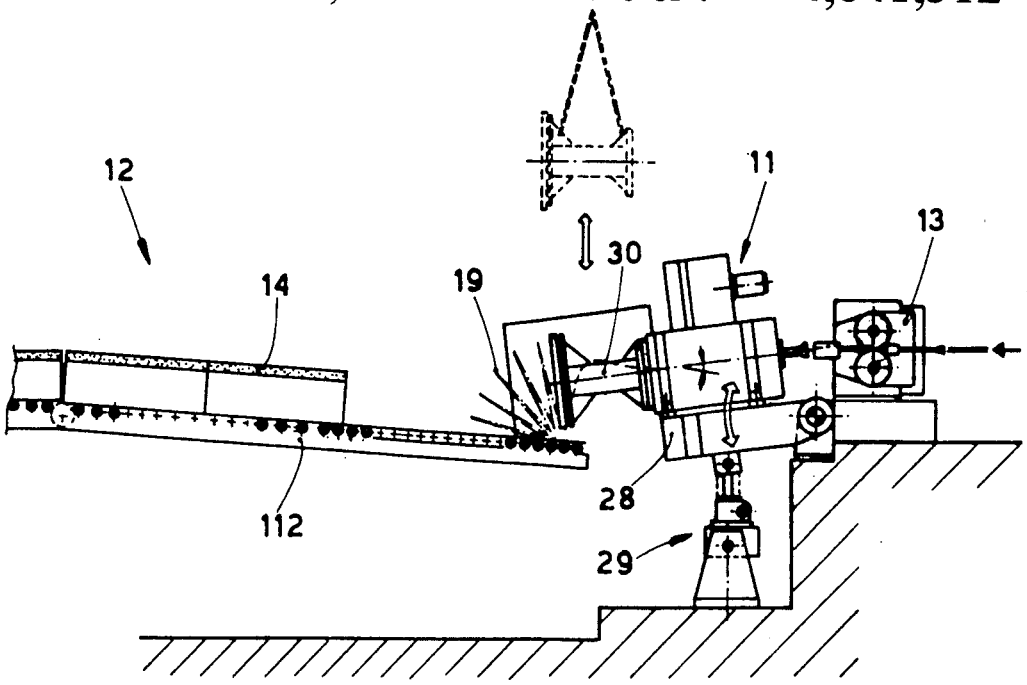
FIGS. 4 and 5 show the formation of horizontal and vertical coils respectively.
Figure 5:
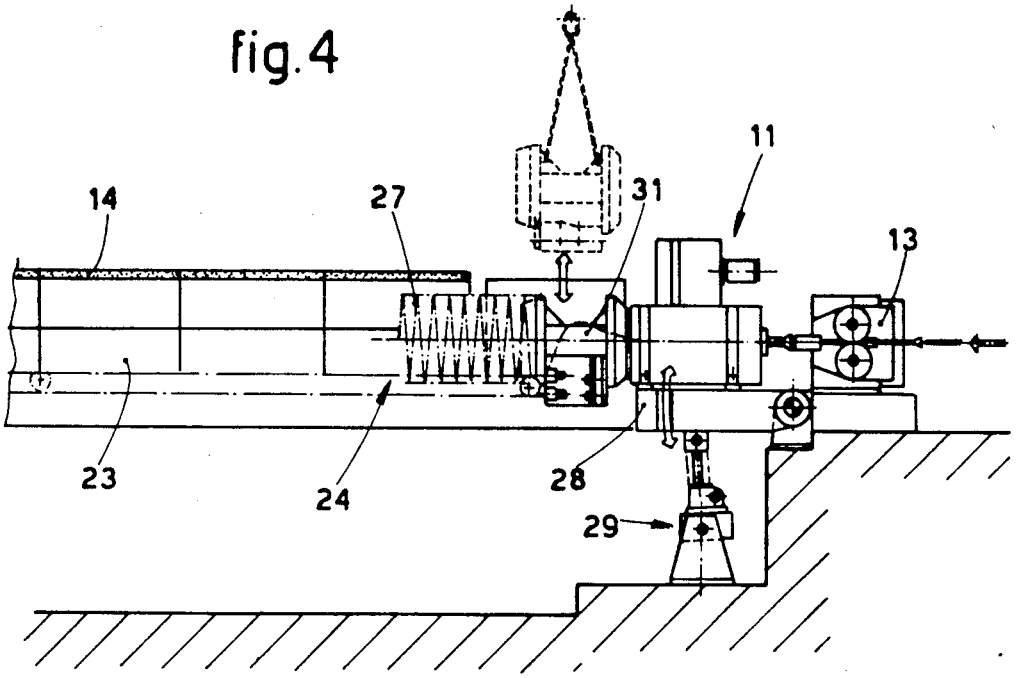

FIGS. 4 and 5 respectively show the formation of horizontal coils 19 and vertical coils 27. In FIG. 4 the coil-forming head 11 is installed on a base 28 which can be tilted so as to enable the coils 19 to be formed and deposited on the roller conveyor 12, which comprises an articulated portion 112 that can be tilted downwards; the purpose of this is to enable the coil-forming head 11 to be tilted.

An actuator means 29 can be seen which controls and actuates the tilting of the base 28 and therefore of the coil-forming head 11. The drawing roller unit 13 can be seen in FIGS. 4 and 5 immediately upstream of the head 11.

In this example the coil-forming head 11 has two interchangeable headstocks 30–31 for depositing horizontal coils 19 (FIG. 4) and vertical coils 27 (FIG. 5) respectively. Such headstocks 30–31, however, are not a part of this invention and therefore will not be described further.

Instead of the coil-forming head 11 shown, any required type of coil-forming head known in the art can be employed.

In particular, it will be noted that in FIG. 5 the cooling tunnel 50 is formed with the hoods 14 cooperating at their lower end in a lifted position with the side panels 23.

Figure 6:
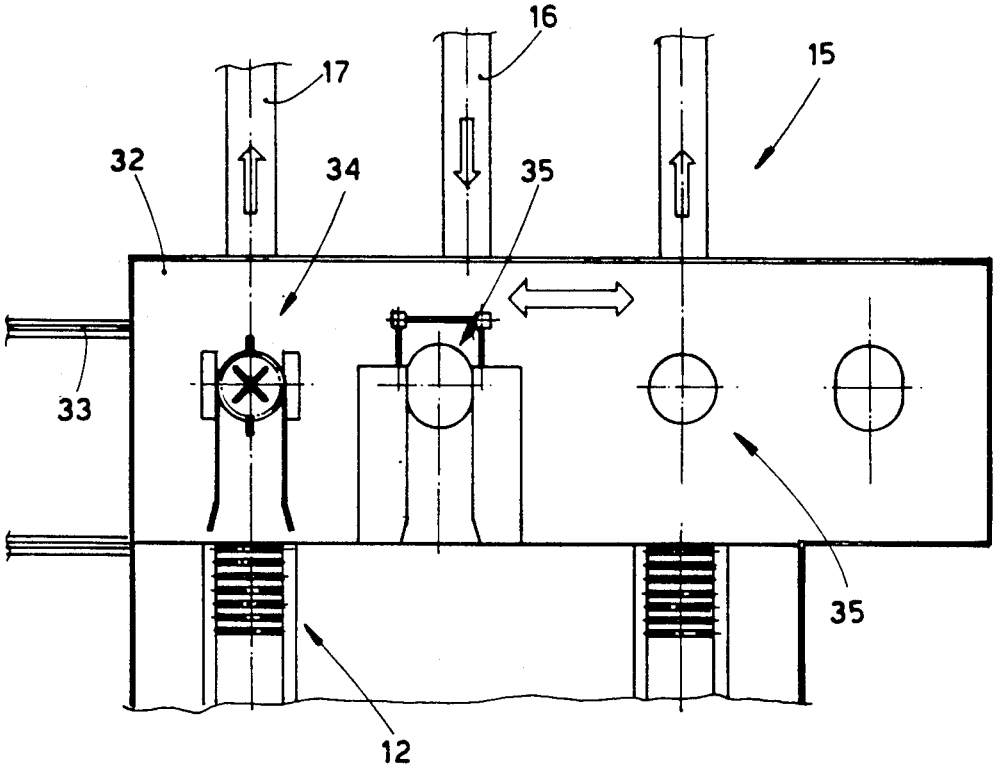
FIG. 6 shows in particular a plan view of the station to form wound bundles.

FIG. 6 gives a detailed plan view of the station 15 where wound bundles are formed; this station 15 comprises a trolley 32 which runs on rails 33 crosswise to the cooling roller conveyors 12.

This trolley 32 includes two cooling pits 34 and 35 respectively to serve the cooling roller conveyors 12. The pit 34 serves to form wound bundles from vertically positioned coils 27, whereas the cooling pit 35 serves to form wound bundles from horizontal coils 19. If the trolley 32 is moved, it is possible to make the pit 34 or pit 35 respectively coincide with each of the conveyors 12, depending on the type of coils 27 or 19 respectively being handled.

Figure 7:
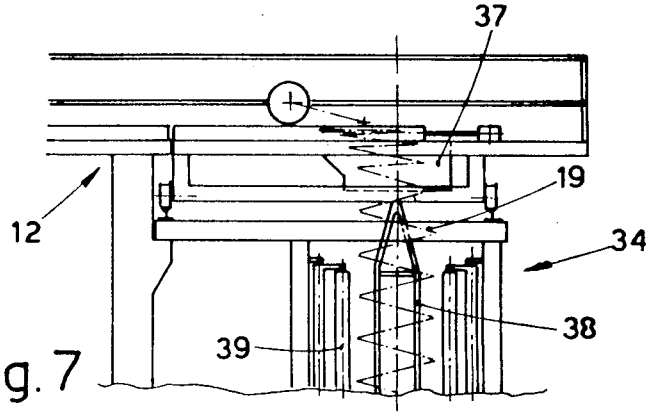
FIGS. 7 and 8 show the formation of a wound bundle with horizontal coils and vertical coils respectively.
Figure 8:
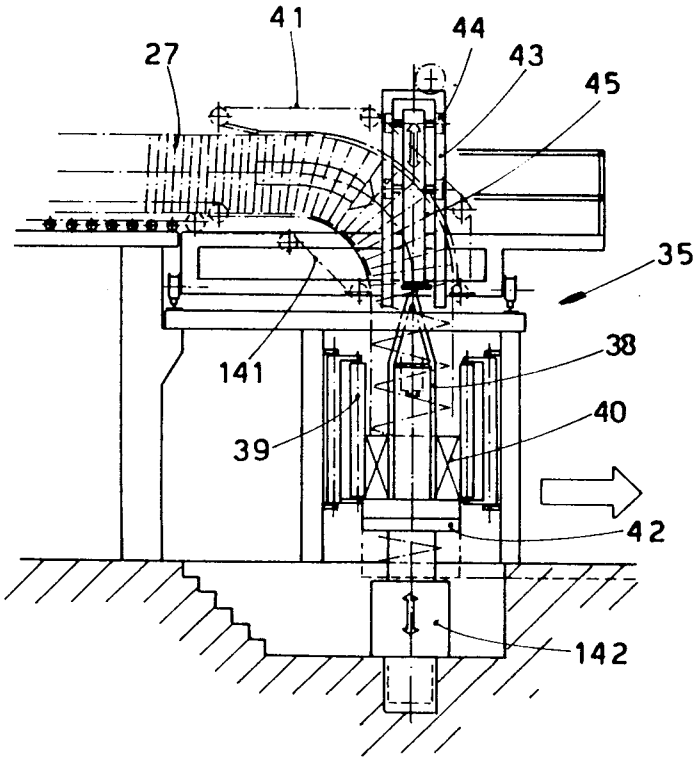

FIGS. 7 and 8 respectively show in detail the pit 34 to form bundles from horizontal coils 19 and the pit 35 to form bundles from vertical coils 27.

In FIG. 7 can be seen the end of the conveyor 12 from which the coils drop into the pit 34, being expedited by known lead-in funnel means 37.

The coils are gathered on a reel 38, and the figure shows also auxiliary rollers 39 to contain the periphery of the bundle being formed. As soon as a wound bundle 40 has been formed, it can be suitably compacted with known means and be withdrawn with the reel 38 on the discharge conveyor 17 (see FIG. 6).

FIG. 8 shows the method of forming a bundle 40 wound about a reel 38 when using vertical coils 27. Here too auxiliary rollers 39 can be seen in the pit 35 to form wound bundles.

In this case the reel 38 cooperates with a rotary platform 42 capable of being lifted vertically by drive means 142. Such vertical movement serves to lift the reel 38 to its working position for formation of a bundle and then to take it back into contact with the discharge conveyor 17 for discharge together with the wound bundle 40.

This figure shows guide chains 41–141 that serve to guide the vertical coils 27 when the latter are turned over to their horizontal position to form a wound bundle.

The figure also shows compaction means 43 of a known type, which consist of a movable element guided by guide rollers 44. An actuator 45, which is a jack in this example, serves to drive the compaction means 43, which press on the top of the wound bundle 40 and thrust it downwards.

Lastly, FIG. 9 shows a possible embodiment of reel means 138 equipped with means 46 to hold the wound bundle.

As an example, such means 46 in FIG. 9 comprise two lever arms 47, which normally form a part of the point of the reel 138.

When the wound bundle 40 has been formed, it is compacted with known means. So as to prevent the bundle unwinding when the coils are released because of the resilience of the latter, before the compactin means (not shown here) are withdrawn, the arms 47 are swung upwards to position 47A and are held there by catch means of any type, which are known and are not shown.

The arms 47 are actuated by external thrust means 49, such as a vertically movable shaft driven, for instance, by a jack and introduced from below into the reel 138. In this example the shaft 49 will act on the ends 147 of the lever arms 47 pivoted at 48.

I claim:

1. A plant to form and cool metal coils, comprising:

a conveyor for horizontal coils;

conveyor means for vertical coils located adjacent said conveyor adapted to convey vertical coils directly above said conveyor, said conveyor means being movable from an inactive to a working position;

at least one coil-forming head to form horizontal and vertical coils and place the same on one of said conveyor and said conveyor means;

a movable cooling hood having a top wall and spaced-apart depending opposed side walls, said hood being movable from a first lower position over horizontal coils on the conveyor to a second upper position over vertical coils on the conveyor means;

movable side walls adapted to move from an inactive position when said cooling hood is in its first position to a working position adjacent to and coplanar with the depending side walls of the cooling hood when the cooling hood is in its second position, whereby said movable side walls together with said hood form a cooling tunnel; and a station for receiving either horizontal or vertical coils and forming wound bundles.

2. A plant as claimed in claim 1, wherein said conveyor means and said movable side walls are joined to pivotally move together from their respective inactive to their respective working positions.

3. A plant as claimed in claim 1, further comprising means to lift the movable hood to the second position.

4. A plant as claimed in claim 1 wherein said station comprises at least one trolley movable transversely to the conveyor and conveyor means, at least one pit to form wound bundles of horizontal coils, and at least one pit to form wound bundles of vertical coils.

5. A plant as claimed in claim 1, further comprising a reel on which to form wound bundles of coils.

6. A plant as claimed in claim 5, further comprising means for compacting a wound bundle on said reel and means to hold the thus-compacted bundle.

* * * * *